US005087154A

United States Patent [19]

Crawford

[11] Patent Number: 5,087,154

[45] Date of Patent: Feb. 11, 1992

[54] COATINGS AND PROCESS AFFORDING CORROSION PROTECTION FOR MARINE STRUCTURES

[75] Inventor: David W. Crawford, Houston, Tex.

[73] Assignee: MPT Services, Inc., Houston, Tex.

[21] Appl. No.: 583,282

[22] Filed: Sep. 17, 1990

[51] Int. Cl.[5] ..... E02D 5/60; E02D 31/06

[52] U.S. Cl. ..... 405/216; 405/211

[58] Field of Search ..... 405/195, 211, 216; 52/169.13, 170, 727, 728

[56] References Cited

U.S. PATENT DOCUMENTS

| | | | |
|---|---|---|---|
| 2,200,469 | 5/1940 | Cox | 204/1 |
| 3,370,998 | 2/1968 | Wiswell, Jr. | 156/71 |
| 3,719,049 | 3/1973 | Shaw et al. | 61/54 |
| 3,996,757 | 12/1976 | Liddell | 61/54 |
| 4,019,301 | 4/1977 | Fox | 52/725 |
| 4,283,161 | 8/1981 | Evans et al. | 405/216 |
| 4,527,928 | 7/1985 | Rutherford et al. | 405/211 |
| 4,614,461 | 9/1986 | Taniguchi et al. | 405/211 |
| 4,619,557 | 10/1986 | Salama et al. | 405/211 |
| 4,629,366 | 12/1986 | Rutherford et al. | 405/211 |
| 4,634,314 | 1/1987 | Pierce | 405/195 |
| 4,743,142 | 5/1988 | Shiraishi et al. | 405/216 |
| 4,918,883 | 4/1990 | Owen et al. | 405/216 X |

FOREIGN PATENT DOCUMENTS

| | | | |
|---|---|---|---|
| 58-496 | 12/1983 | Japan | 405/216 |
| 1439214 | 6/1976 | United Kingdom | 405/216 |

*Primary Examiner*—David H. Corbin
*Attorney, Agent, or Firm*—Daniel Rubin

[57] ABSTRACT

An epoxy coating composition, a coating and a method of applying the coating composition to items to be used or being used in marine environments and otherwise susceptible to the deleterious effects of erosion and/or corrosion. The coating composition is comprised of a polyamine converter and an epoxy resin that can be applied either to virgin metal or to preexisting metallic items immersed below sea level. The coating in either situation is comprised of a plurality of layers of the epoxy composition sequentially applied about the affected surface area of the item with a wrap of vitrified cloth disposed intervening between juxtaposed of said layers. Where on site restoration of an item is to be performed, some or all of the layer applications can be conducted underwater by preceding application of the coating with an abrasive blasting of the surface to be coated.

21 Claims, 1 Drawing Sheet

COATINGS AND PROCESS AFFORDING CORROSION PROTECTION FOR MARINE STRUCTURES

FIELD OF INVENTION

The field to which the invention relates comprises the art of corrosion protection for structures being used or to be used in marine environments.

BACKGROUND OF THE INVENTION

Installation of various type metal structures in corrosive liquids such as sea water are confronted with a major problem in avoiding the adverse effects of corrosion and erosion. Either can severely reduce the life expectancy of the structure. Exemplifying the situation are structures such as off-shore rigs for recovering oil in the many oceans and seas of the world. Briefly such structures include not only supports for the rig itself, but also risers comprising conduits through which recovered oil is transmitted. Typically, the various structural items and/or risers are pre-coated, encased or otherwise provided with cathodic protection or the like in order to ward off or deter the deleterious corrosive effects of the sea water. Little has been known however, how to restore such risers on site after the onset of corrosion when the original protective coating, etc., has begun to wear or generally deteriorate. Temporary repair or replacing the affected structures has been customary although undesirable because of the associated high costs and less than satisfactory results.

BACKGROUND OF THE PRIOR ART

There have been many attempts to passivate the adverse effects of impact/abrasion and corrosion to structural members of offshore platforms, drilling rigs, pipelines, risers, pilings, wharfs, or any edifice that is located in the splash or tidal zones of a marine environment. There are several known techniques for applying pre-installation protection to metallic structures for protecting them from the ultimate effects of corrosion and erosion that attack the supports of the structure located in the splash zone. By way of example, steel pilings and/or production piping are usually covered with a rust-resistant inorganic coating during the fabrication phase of new construction. Exemplifying such coatings are the disclosures of U. S. Pat. Nos. 3,370,998; 4,619,557; and 4,743,142.

Once a structure such as a production platform is emplaced offshore and subjected to prolonged exposure of the marine environment during normal operating procedures, previously coated steel surfaces tend to become slowly penetrated and eroded to a point whereby the existing steel substrate is ultimately exposed. The corrosion rate of steel in the splash zone is typically about 100 mils per year. Normally these steel support members, without good repair procedures, will lose their structural integrity after about seven to ten years of exposure. The replacement cost of risers and other steel supports in situ offshore are considered extremely expensive such that replacement is preferred to be avoided.

Over the last couple decades, coating manufacturers have formulated epoxy resins that will cure under water. These materials were primarily developed for spot repair usage and have enjoyed some limited success on small projects. Historically, these formulations are based on polyamide cured epoxy resins that are heavily filled with inert inorganic compounds, i.e., silica flour or mica, to produce increased viscosity, thixotropy and solids by weight. These properties are essential in order to reduce the possibility of the material being "washed off" by encountered wave action.

Despite existence of such conventional underwater epoxy formulations, a problem has been a lack of sufficient adhesion of the epoxy with the applied surfaces. The end result has been a more or less "envelope" effect, whereby the coating does not bond tenaciously to the substrate surface particularly in repair situations where an onset of corrosion or erosion has already been encountered. Under those circumstances, indiscriminate delamination or spalling usually occurs within the first year after application.

OBJECTS OF THE INVENTION

It is therefore an object of the invention to provide a coating that affords relatively superior protection against corrosion and erosion of support structures in a marine environment.

It is a further object of the invention to achieve the previous object by a method of coating which can be applied on site and underwater as a restoration to an existing support structure.

It is a still further object of the invention to achieve the previous objects with an adhesion type barrier coating continuously maintained in a compression relation.

SUMMARY OF THE INVENTION

This invention relates to a novel coating and method of applying such coating to afford corrosion and erosion protection to a support structure to be used or being used in a marine environment. More specifically, the invention relates to such a coating and method of application that can be either pre-applied during initial fabrication or post-applied on site to existing support structures in need of repair o restoration. In either situation, the life expectancy of the structure upon which the coating hereof has been applied can typically be increased by at least about three years over the otherwise current life expectancy of such structures.

The process hereof for achieving the foregoing enables a continuous application of a uniform coating thickness over most any cross-sectional configuration. The coating is comprised of a solvent-free, 100 percent solids by volume epoxy polyamine adhesive that is applied either to surface prepared virgin metal as a fabrication coating or, in the case of restoration, over a previously abrasive blasted metallic substrate that is fre of scale, oxidation and/or chemical contamination. By means of the method and coating hereof, the utilized polyamine formulations of epoxy adhesive provide characteristics that displaces water and creates a strong molecular attraction or adhesive strength to the substrate.

Forming the coating is a plurality of adhesive layers of controlled thickness successively applied alternately with a wrap of vitrified glass cloth intervening between layers. The end result is a bond between the substrate and the polyamine adhesive that exceeds 1500 PSI (ASTM D 4541). With a vitrified (glass) fibrous cloth being spirally wrapped in controlled sequence over each preceding uncured layer of epoxy, the epoxy adhesive permeates through the glass cloth and forms a reinforced labyrinth-type barrier coating. The alternate application of epoxy adhesive layers and wrapping is continuously repeated until a system preferably of at least three epoxy layers is completed.

For restoration application of the coating, surface preparation of the recipient structure is conducted prior to coating by underwater abrasive blasting utilizing compressed air of about 100 PSI. This is a known procedure accepted in engineering specifications of the marine/offshore industries. Abrasive blasting underwater is, however, normally limited to conditions of water depth (atmospheres) above increasing the outside diameter pressure on the air hose to a point which constricts the air volume below 100 PSI and becomes non-productive.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
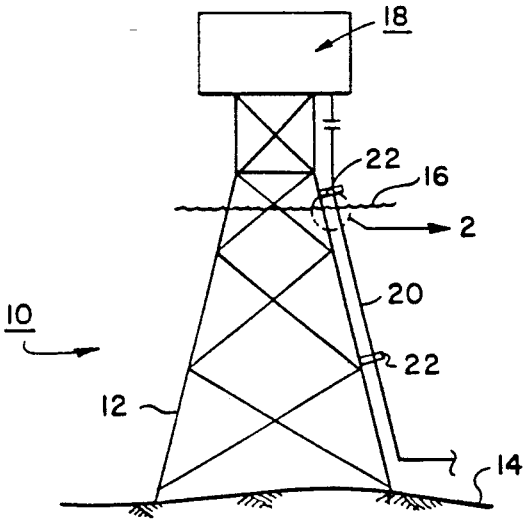
FIG. 1 is a schematic illustration of a typical offshore platform.

In the description which follows, like parts are marked throughout the specification and drawings with the same reference numerals respectively. The drawing figures are not necessarily to scale and in certain views parts may have been exaggerated for purposes of clarity.

Figure 2:
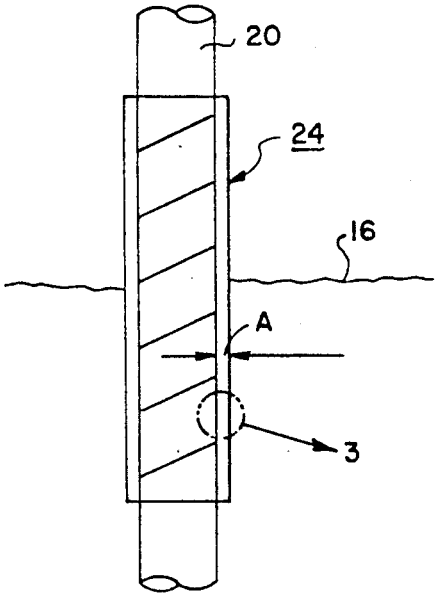
FIG. 2 is an enlarged fragmentary section of the encircled portion 2 of FIG. 1.
Figure 3:
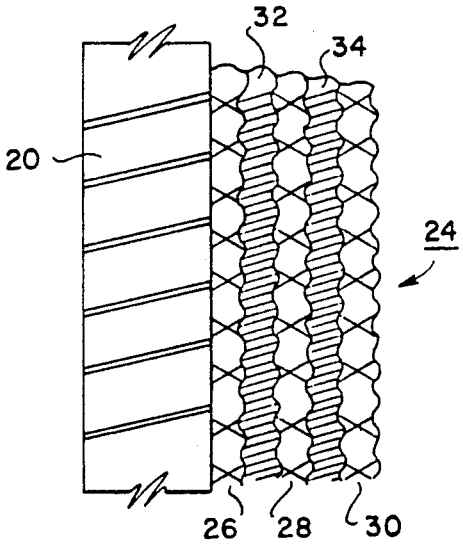
FIG. 3 is a further enlarged fragmentary section of the encircled portion 3 of FIG. 2.

Referring now to the drawings, there is illustrated in FIG. 1 an exemplary use of the coating and method hereof as represented by an offshore platform designated 10 secured via a support structure 12 to the sea bottom 14. Above sea level 16, there is provided a working deck 18 from which a pipeline riser 20 dependently extends while secured via clamps 22 to the support structure 12. For inhibiting the adverse effects of corrosion and erosion in the splash or tidal zone there is provided on riser 20, as illustrated in FIGS. 2 and 3, a coating of the invention herein designated 24. The coating is comprised of a plurality of adhesive layers 26, 28 and 30 contiguously separated by intervening spiral wound layers of glass cloth 32 and 34.

As will be understood, the coating 24 hereof is useful as a preliminary coating applied during initial fabrication prior to installation of riser 20. Alternatively, it can be applied for restoration purposes during post-installation service on site following some initial deleterious onset of corrosion and/or erosion effects on the riser. During fabrication, the coating hereof can be applied directly to abrasively blasted virgin metal as a substitute for other inhibitive type coatings of a type which have been applied for many years or can be applied in combination therewith. Typically, use of prior art coatings in the combination would be applied ove the instant coating for aesthetic purposes such as for coloring and/or gloss retention. For restoration or repair of existing structures, the affected surface is first abrasively blasted above and below water level to a near white finish in accordance with the Steel Structures Painting Council (SSPC-SP10). This has the effect of removing all rust, oxidation, scale and chloride contamination from the riser surface. Depth of anchor profile should be a minimum of at least about 3 mils so as to remove imbedded contaminants consisting of mil scale (new steel) or $Fe_2O_3$, chlorides, chromates and nitrates that exist on deteriorated steel.

Comprising each of the adhesive layers 26, 28 and 30 is a solvent free, 100 percent solids by volume epoxy polyamine adhesive coating formulated for underwater curing. An essential property of the layers hereof is their tenacious adhesive characteristics when applied directly to a properly prepared steel substrate. This has been achieved herein with an epoxy resin (A) and converter (B) mixed together in equal proportions from the following ingredients:

(A) (percent by volume)

(a) Bisphenol-F epoxy resin (about 80–95%)
(b) fumed silica (about 5–10%)
(c) coloring matter such as carbon black (about less than 5%)

(B) (percent by volume)

(a) polyamine compound (about 80–95%)
(b) alkyl substituted amino-phenol (about 5–15%)
(c) barium sulphate (about 5–10%)
(d) organic acid (less than about 5%)

The epoxy resin (A) when mixed with the converter reactor (B) has been found to develop a very high degree of molecular attraction through exothermic polymerization to the steel substrate. The phenomenon is sometimes termed "good wetting", i.e. the surface of steel contains multiple layers of water molecules and the composition hereof provides molecular attraction by diffusing through those water layers by emulsification (or disperses the water through the adhesive so that contact to the steel is accomplished). This is an essential step that an adequate degree of adhesion develop during the curing state. Emulsification is attributed to the hydrophobic fatty acid portion of the polyamine molecules, which in combination with the hydrophilic portion of the molecule acts as the emulsifier. This contrasts with the polyamide products currently used for quick repair procedures, that fail to develop this molecular attraction or "adhesive quality". Instead, as noted supra, the polyamides are considered an envelope and therefore cannot obtain the adhesion qualities achieved hereby.

In addition to the foregoing, it has been found that the resulting epoxy composition is able to withstand temperatures of down to 45° F. and pressures to at least 1,500 pounds per square inch without adversely affecting its curing capabilities. Whether applied to new riser structures prior to installation or to post installed structures subsequent to abrasive blasting, the two-part epoxy formulation with preferably a black and white pigmentation respectively is first mixed in equal proportions. When properly mixed, the epoxy will appear as a uniform dark gray color with a consistent smooth viscosity free of lumps or undissolved particles having a workable pot life of approximately forty minutes at 80° F.

Subsequent to preparation of the epoxy mixture, the first step is to apply a controlled quantity of still viscous epoxy mixture uniformly above the surface of riser 20 by a workman wearing neoprene gloves or by a roller to form a wet film thickness (WFT) layer 26 of approximately 30–35 mils. Immediately thereafter, a length of vitrified foraminous cloth 32 is spirally wrapped about the uncured layer 26 to about a 50 percent overlap. This insures that the adhesive of layer 26 will thoroughly permeate the glass wrap 32 while receiving an adequate degree of compression for effecting a kinetic energy storage.

Comprising glass wrap 32 is a standard woven glass matrix available commercially from a variety of mill sources in the U.S.A. as glass cloth. Preferably, the cloth is in untreated virgin condition to avoid uncontrolled action with the exothermic properties. Typically, the cloth is about 0.012 inches thickness, weighs about 8.71 ounces per square yard and has an untreated breaking strength of about 300–400 pounds per inch with filling picks (void spaces) in excess of 17 per inch. The vitrified cloth is preferred for its excellent structural strength which acts much like a rebar does to concrete.

Promptly after applying the fiberglass cloth 32, a second adhesive layer 28, similar to layer 26, is superimposed onto the cloth 32 to a similar thickness of 30–35 mils. This in turn is followed by a second application of wrapped fiberglass cloth 34 in turn followed by a final application of adhesive 30 to a similar thickness of 30–35 mils.

Following application of layer 30, the dimension "A" (FIG. 3) of coating 24 should be approximately 100–125 mils dry film thickness (DFT). The cure rate will vary with atmospheric and water temperatures. At 80° F. the system will cure hard within about two hours. Final cure above and below ater normally occur within 24 hours when applied in water temperatures of at least about 55° F. Subsequent to final cure, the completed coating typically is inspected to inusre that all surfaces are free of blisters that denote penetration, or any evidence of delamination. If any of these deficiencies are present, spot repair can be effected in an expeditious manner. Application time will, of course, vary depending on the size of any given project. Best results are obtained when all steps of the process are continuously applied in orderly sequence with a minimum of interruption. This serves to minimzie the opportunity for any surface contamination following abrasive blasting of the metal surface.

Most applications of the coating are performed by trained and competent painters in the minus (−)3 to (−)5 foot level in the splash zone. When water depth exceeds about five feet, application of the coating usually requires special equipment and use of divers. It is anticipated that the process hereof can be successfully applied to water depths of at least 100 feet.

When the coating 24 has been properly applied, it is anticipated to extend initial life expectancy of the recipient structure for at least three additional years compared to present coatings initially applied for that purpose. At the same time, the benefit in a restoration situation is anticipated to be far superior to repair methods presently utilized by extending th practical life of the structure for at least three additional years. Even then, should subsequent breakdown of the coating occur, additional restoration coatings can be applied over a space of time when required any number of times for so long as the basic structural integrity of the metal structure remains.

By the above description, there is disclosed a novel coating composition, coating and method of applying the coating onto corrosion susceptible support structures affording superior protection for a structure subject to marine environment exposure. By forming an epoxy coating composition having superior adhesion properties and applying the composition in a plurality of layers somewhat separated from each other via intervening wrappings of glass cloth, unusually long-lasting barrier protection is achieved. When constructed in this manner, the resultant coating is sufficiently durable to withstand anticipated erosion effects for prolonged time periods, during which it is unpenetratable by sea water. Whereas the coating has been described a preferably having three adhesive layers applied over intervening layers of vitrified cloth, the number of actual layers could, of course, be modified where conditions warranted. It is reasonable that a least two layers be utilized but the coating can comprise any additional layers numbering three or more.

Since many changes could be made in the above construction and many apparently widely different embodiments of this invention could be made without departing from the scope thereof it is intended that all matter contained in the drawings and specification shall be interpreted as illustrative and not in a limiting sense.

I claim:

1. A protective coating on a corrosion susceptible item adapted for use in a marine environment comprising at least two uninterrupted encapsulating and superposed layers of a marine resistant epoxy composition applied onto a select surface portion of the item and a thin layer of reinforcing composition extendign contiguously intervening between the superposed of said epoxy layers.

2. A coating in accordance with claim 1 in which the said at least two superposed layes of expoxy comprise a plurality of such layers in a quantity greater than two and said reinforcing composition is disposed intervening between each of said superposed layers.

3. A coating in accordance with claim 1 in which said reinforcing composition comprises an epoxy permeable fibrous material in which the epoxy of at least one of said superposed layers has permeated.

4. A coating in accordance with claim 3 in which said reinforcing composition comprising a vitrified cloth.

5. A coating in accordance with claim 3 in which said reinforcing composition comprises a vitrified cloth of about 0.012 inches in thickness and having a breaking strength of at least 400 plus 380 pounds per inch.

6. A coating in accordance with claim 3 in which said reinforcing composition intervenes in a compressive wrap relation about the innermost of the superposed layers.

7. A coating in accordance with 1 in which said epoxy composition comprises a two-part mixture in substantially equal proportions of a polyamine converter and an epoxy resin operative to adhesively secure to said select surface portion.

8. A coating in accordance with 7 in which said epoxy resin is comprised in percent by volume of Bisphenol-F epoxy resin (about 80–95%); fumed silica (about 5–10%); and coloring matter (about less than 5%); and said converter is comprised in percent by volume of polyamine compound (about 80–95%); alkyl substituted amino-phenol (about 5-15%); barium sulphate (about 5–10%); and organic acid (less than about 5%).

9. A corrosion resistant coating composition formed when mixed of an epoxy resin in substantially equal proportions with a polyamine converter.

10. A coating in accordance with claim 9 in which said epoxy resin is comprised in percent by volume of Bisphenol-F epoxy resin (about 80–95%); fumed silica (about 5-10%); and coloring matter (about less than 5%); and said converter is comprised in percent by volume of poylamine compound (about 80–95%); alkyl substituted amino-phenol (about 5–15%); barium sulphate (about 5–10%); and organic acid (less than about 5%).

11. A method of applying a protectvie coating onto a corrosion susceptible item adapted for use in a marine environment comprising the sequential steps of:

a. applying a first uninterrupted layer of a marine resistant epoxy composition in encapsulating relation onto a potentially corrosive/erosive susceptible surface of said item;

b. applying a first layer of a fibrous reinforcing composition overlying said first epoxy layer while the epoxy thereon is still uncured;

c. applying a second uninterrupted layer of a marine resistant epoxy composition in encapsulating relation and superposed to said first applied epoxy layer and the previously applied reinforcing composition; and d. permitting said first and second epoxy layers to cure to a predetermined hardness.

12. The method in accordance with claim 11 in which the step of applying said fibrous composition comprises spiral wrapping a strip of said composition onto said first epoxy layer.

13. The method in accordance with claim 12 including the additional uninterrupted superposed steps of applying additional layers of epoxy composition by alternately applying said fibrous composition onto each preceding epoxy layer and applying an epoxy layer over each preceding layer of said composition.

14. The method in accordance with claim 12 in which said fibrous composition comprises a vitrified cloth.

15. The method in accordance with claim 11 in which said coating is to be applied for restoration of an item existing in a marine environment and said coating application steps are preceded by the step of cleaning existing corrosion from the surface of the item onto which the coating is to be applied.

16. The method in accordance with claim 12 in which said corrosion cleaning step comprises abrasive blasting the surface.

17. The method in accordance with claim 16 in which said coating application steps are conducted at least partially underwater against an underwater section of said item and said epoxy layers are characterized by underwater curign capability.

18. The method in accordance with claim 17 in which the water of said marine use comprises sea water and said coating is applied to at least a section of said item standing in the splash or tidal zones of said sea water.

19. The method in accordance with claim 18 in which said item comprises a riser on an offshore platform for transmitting oil recovery and said riser extends from near the sea bottom to an above water level location on said platform.

20. The method in accordance with claim 11 in which said epoxy composition comprises a two-part mixture in substantially equal proportions of a polyamine converter and an epoxy resin.

21. The method in accordance with claim 20 in which said epoxy resin is comprised in percent by volume of Bisphenol-F resin (about 80–95%); fumed silica (about 5-10%); and coloring matter (about less than 5%); and said converter is comprised in percent by volume of poylamine compound (about 80–95%); alkyl substituted amino-phenol (about 5–15%); barium sulphate (about 5–10%); and organic acid (less than about 5%).

* * * * *

UNITED STATES PATENT AND TRADEMARK OFFICE

CERTIFICATE OF CORRECTION

PATENT NO. : 5,087,154

DATED : Feb. 11, 1992

INVENTOR(S) : David W. Crawford

It is certified that error appears in the above-identified patent and that said Letters Patent is hereby corrected as shown below:

Col. 2, line 39, "o" should read --or--;
line 51, "fre" should read --free--;

Col. 3, line 61, "ove" should read --over--;

Col. 5, line 30, "ater" should read --water--;
line 41, "minimzie" should read --minimize--;
line 57, "th" should read --the--;

Col. 6, line 9, "a" should read -as--;
line 28, "extendign" should read --extending--;
line 32, "layes of expoxy" should read --layers of epoxy--;

Col. 7, line 8, "protective" should read --protective--;

Col. 8, line 14, "curign" should read --curing--;
line 33, "poylamine" should read --polyamine--.

Signed and Sealed this

Sixth Day of April, 1993

*Attest:*

STEPHEN G. KUNIN

*Attesting Officer*

*Acting Commissioner of Patents and Trademarks*